United States Patent [19]

Rowlands

[11] 4,329,908

[45] May 18, 1982

[54] RECOIL-OPERATED FIRING PIN RETRACTOR FOR ELECTRICALLY-FIRED GUNS

[75] Inventor: Kenneth C. Rowlands, Utica, N.Y.

[73] Assignee: Remington Arms Company, Inc., Bridgeport, Conn.

[21] Appl. No.: 163,308

[22] Filed: Jun. 26, 1980

[51] Int. Cl.[3] ..... F41F 11/02; F41F 13/08

[52] U.S. Cl. ..... 89/24; 89/27 R; 89/28 R

[58] Field of Search ..... 42/23, 84; 89/24, 27 R, 89/27 A, 149

[56] References Cited

U.S. PATENT DOCUMENTS

| | | | |
|---|---|---|---|
| 383,372 | 5/1888 | Rostel | 89/24 |
| 449,711 | 4/1891 | von Skoda | 89/24 |
| 458,505 | 8/1891 | von Skoda | 89/24 |
| 617,110 | 1/1899 | Lynch | 89/24 |
| 1,040,001 | 10/1912 | Olsson | 89/24 |
| 2,415,952 | 2/1947 | Loomis | 89/24 |
| 2,800,057 | 7/1957 | Hoopes | 89/28 R |
| 2,977,855 | 4/1961 | Catlin et al. | 89/24 |
| 3,763,742 | 10/1973 | Kotas et al. | 89/24 |

*Primary Examiner*—Charles T. Jordan

*Attorney, Agent, or Firm*—Nicholas Skovran; William L. Ericson; Barry Estrin

[57] ABSTRACT

An electrically-fired gun, of the type having a transverse sliding breechblock, has a recoil-operated mechanism for retracting the firing pin electrode tip behind the face of the breechblock during its opening and closing movements. A movable weight is connected by a rocker arm to the firing pin assembly, and is normally latched in place to hold the electrode tip in a retracted position. Manual release of the latch allows a spring to extend the electrode tip into a firing position. Recoil of the gun on firing results in a movement of the weight that retracts the electrode tip, and the parts are automatically re-latched in this position.

10 Claims, 6 Drawing Figures

RECOIL-OPERATED FIRING PIN RETRACTOR FOR ELECTRICALLY-FIRED GUNS

This invention relates to electrically-fired guns, especially those of the type having a breechblock which is slidable transversely of the axis of the barrel between an open position in which the chamber is accessible for loading of a shell, and a closed position in which the breechblock fully encloses the shell for firing. The invention is particularly concerned with a mechanism for retracting the firing pin electrode behind the face of the breechblock during its opening and closing movements, so that the tip of the electrode will not be damaged by dragging over the base of the shell and the breech of the barrel.

A number of known mechanisms for retracting firing pins in transverse-sliding breechblock guns employ mechanical linkages connected with the breechblock-operating mechanism. This is done in percussion-fired guns as an incident to cocking the firing pin, or in electrically-fired guns for the purpose of protecting the electrode tip. Some examples of such mechanisms are shown in U.S. Pat. Nos. 2,800,057—Hoopes; 617,110—Lynch; 1,040,001—Olsson; 383,372—Rostel; 449,711 and 458,505—von Skoda.

The present invention has as its general object the provision of an improved recoil-operated mechanism for retracting an electrical firing pin upon firing of a gun, and for latching the firing pin in the retracted position until such time as the gun has been reloaded and the breechblock reclosed, ready for firing. It is a feature of this mechanism that it is entirely contained within the breechblock, so that it adds no complication to the routine operation of removing the breechblock for cleaning or repair, and requires no readjustment after the breechblock is reassembled in the gun.

Another object of the invention is to provide the gun loader, as a safety measure, with a positive means for controlling a firing pin retractor latch means, so that the gun cannot be fired until he has intentionally released the latch from the firing pin. This feature is of particular importance in applications where the gun is electrically fired from a remote source. One application of this kind is in the field of geophysical exploration, where such guns serve as a means of impacting the earth to generate seismic waves from which subterranean geology may be determined.

The improved recoil-operated firing pin retractor employs a movable inertial weight which is connected by a rocker arm to a movable electrical firing pin assembly so that the weight and the firing pin may reciprocate parallel to the axis of the gun barrel, but in opposite directions. The firing pin is normally held in a retracted position, and the weight in a forward position, by a spring-biased plunger latch. By depressing a release button after the breechblock is closed, the gunner may withdraw the plunger latch, which permits a spring to move the weight to a rearward position, and thereby move the firing pin forward into a firing position protruding from the breechblock for contact with the primer of a shell seated in the gun chamber. A projection on the weight holds the plunger latch withdrawn after the release button has been depressed. Upon firing, the gun recoils to the rear, while the inertia of the weight carries it forwardly against the compression of its spring, retracting the firing pin; and the plunger latch is spring-biased into latching engagement with the weight, holding the parts once again in this position as the breechblock is reopened.

Figure 1:
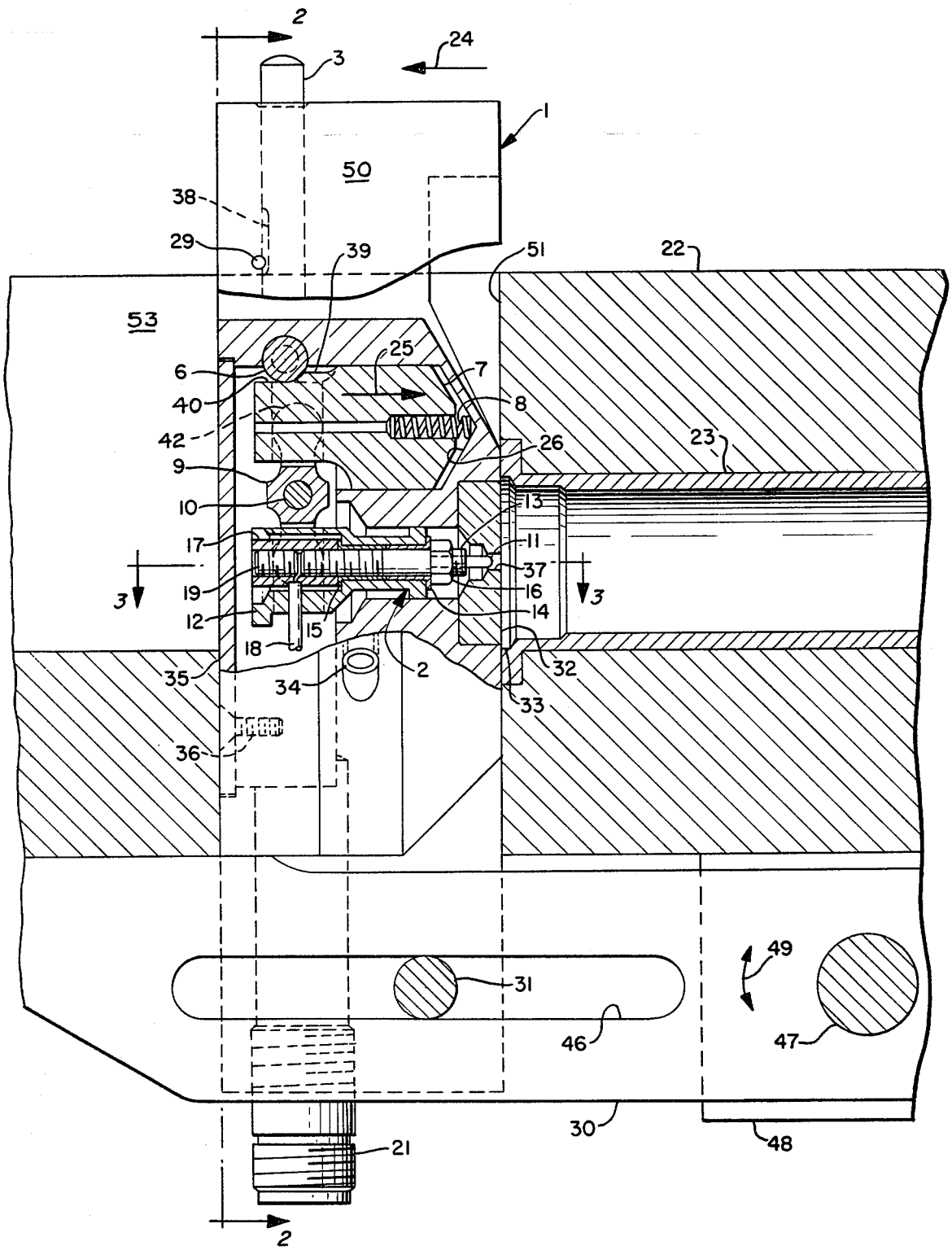
FIG. 1 is a fragmentary cross-sectional view in side elevation of a gun which includes a preferred embodiment of the improved retractor, showing the firing pin assembly in a retracted position.

In the drawings, a preferred embodiment of the improved firing pin retractor is illustrated in an electrically-fired conversion of an industrial gun of a type which is generally shown in U.S. Pat. Nos. 2,415,952—Loomis; 2,977,855—Catlin et al; and 3,763,742—Kotas et al. Guns of this kind have been used in percussion-fired versions for many years, primarily for the purpose of firing slugs into cement kilns to break up clinker rings. A recent development has also applied them to the field of geophysical exploration, as a means of impacting the earth to generate seismic waves from which subterranean geology can be determined. For this purpose, it is sometimes desired to fire a gun from a remote point, or to fire a number of guns simultaneously from a remote point; and this is conveniently provided for by using an electrical firing system.

The illustrated gun has a frame 48 on which are secured a yoke or receiver 22, and a barrel 23 mounted in the yoke. The barrel is formed at its breech end with a chamber 33 for receiving an ammunition shell (not shown) having an electrically ignited primer, and suitable for the intended use of the gun. The yoke 22 is formed with a transverse passage 51 opening into the breech of the barrel, and a breechblock 1 is slidable in this passage, transversely to the axis of the barrel. An operating arm 30 is pivoted at 47 in the frame 48, and a pin 31 secured to the breechblock is slidably received in an elongated slot 46 in the operating arm. By turning the operating arm in directions shown by the arrow 49 in FIG. 1, the breechblock 1 may be reciprocated between a lowered position (not shown) in which the chamber 33 is open for reloading, and a raised position shown in FIG. 1, in which the chamber is closed for firing a shell seated therein. U-shaped recesses 50 and 53 are formed in the top of the breechblock and the yoke to facilitate reloading. A cover plate 35 is secured to the rear face of the breechblock by screws 36 to prevent moisture and foreign matter from reaching the interior.

The breechblock 1 is formed with a stepped bore 37, which extends through a pressure plate 32 secured in the front face of the breechblock. The bore 37 is concentric with the axis of the barrel 23 in the closed position of the breechblock. This bore slidably receives an electrical firing pin assembly 2 for movement between a retracted position shown in FIGS. 1-3, in which a electrode tip 11 is withdrawn behind the front surface of the breechblock, and a firing position shown in FIGS. 4–6, in which the electrode tip protrudes from the breechblock for contact with the primer of a shell (not shown) seated in the chamber 33.

The firing pin assembly 2 includes a tubular housing 12 slidable in the bore 37, and insulated by two opposed flanged bushings 14 and 15, which are made of a suitable insulating material, from a firing pin stud 13. The electrode tip 11, which is made of a suitable spark erosion-resistant material, is brazed into a hole in the stud 13. The stud is secured to the housing 12 by a nut 16 and a connector sleeve 17 threaded on its opposite ends. An insulated electrical lead 18 passes through aligned holes in the walls of the housing 12 and sleeve 17, and is clamped in electrical contact with the stud 13 by a screw 19 threaded into the sleeve 17. The lead 18 is also connected to a banana plug 20 (see FIG. 2) received in a conventional receptacle 21, for electrical connection to a suitable switch and power source (not shown). A circuit is completed from the power source through the tip 11, the primer of a shell in the chamber 33, the gun barrel, and thence to ground, when the firing pin assembly is advanced as in FIGS. 3–6, and the switch is closed to fire the shell.

The firing pin assembly 2 is movable between its retracted and firing positions by a rocker arm 9, which is pivotally mounted in the breechblock on a pin 10, and has bifurcated arms 45 (best shown in FIGS. 4–6) rockably engaged in recesses 44 formed in the sides of the housing 12. The rocker arm 9 has a second pair of bifurcated arms 42 rockably engaged in recesses 43 formed in the sides of an inertial weight member 7, which is slidable in a blind bore 26 in the breechblock, in parallel directions to the firing pin assembly. A compression spring 8 biases the weight 7 toward a rearward position shown in FIGS. 4–6, and acts through the rocker arm 9 to bias the firing pin assembly toward its firing position.

Figure 2:
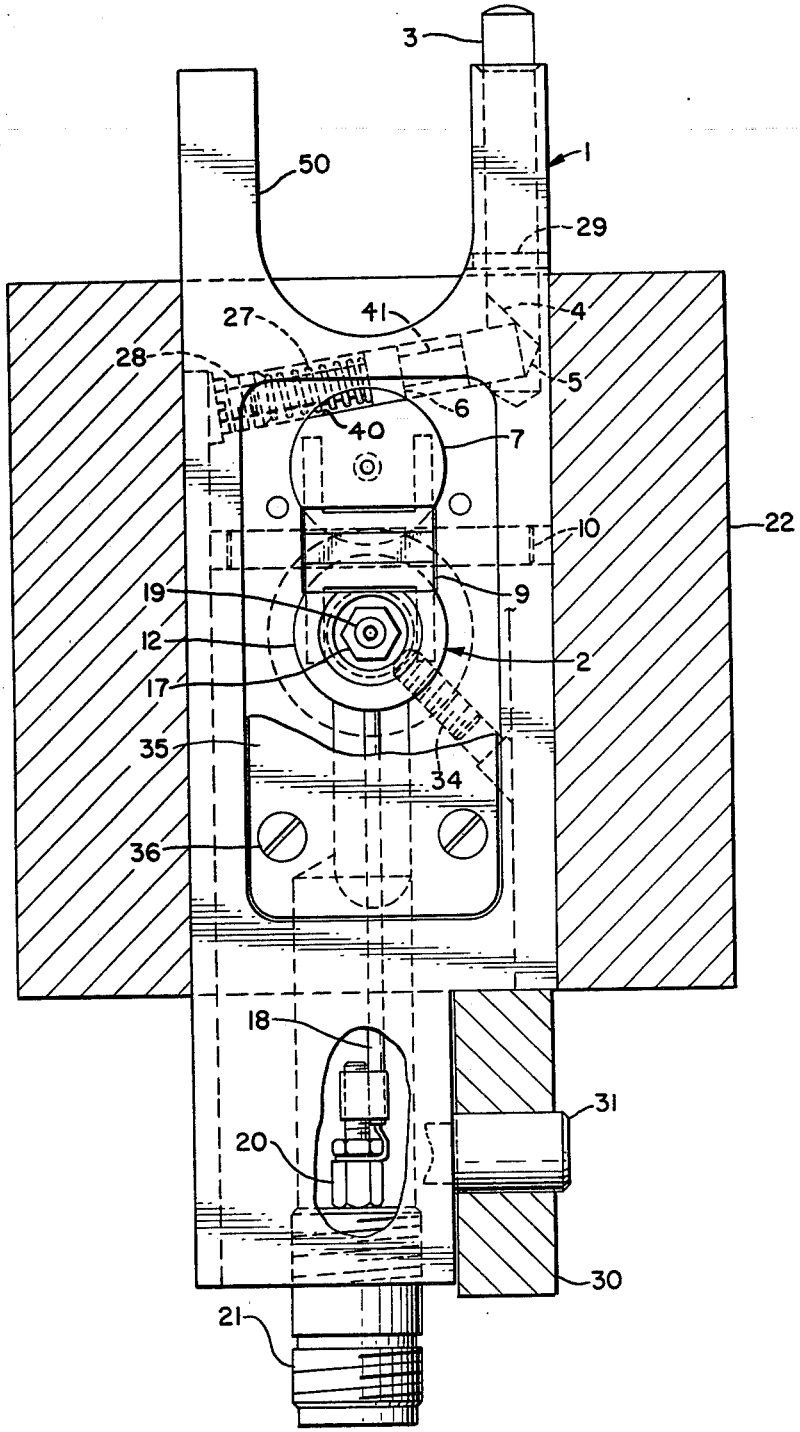
FIG. 2 is a fragmentary sectional view in rear elevation, taken along line 2—2 in FIG. 1, looking in the direction of the arrows.
Figure 3:
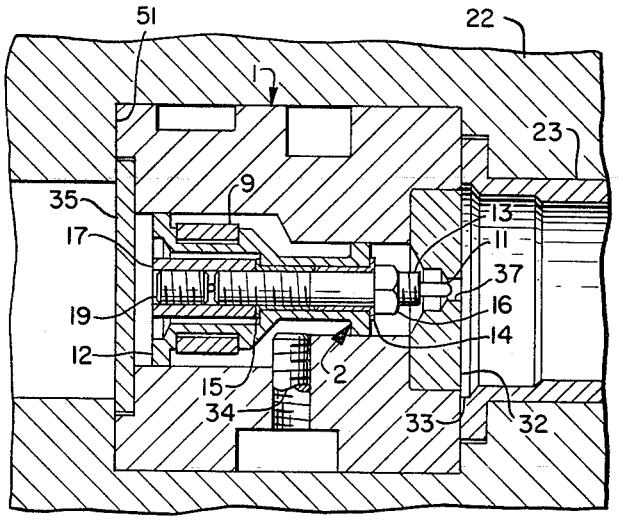
FIG. 3 is a fragmentary sectional plan view taken along line 3—3 in FIG. 1, looking in the direction of the arrows.
Figure 6:
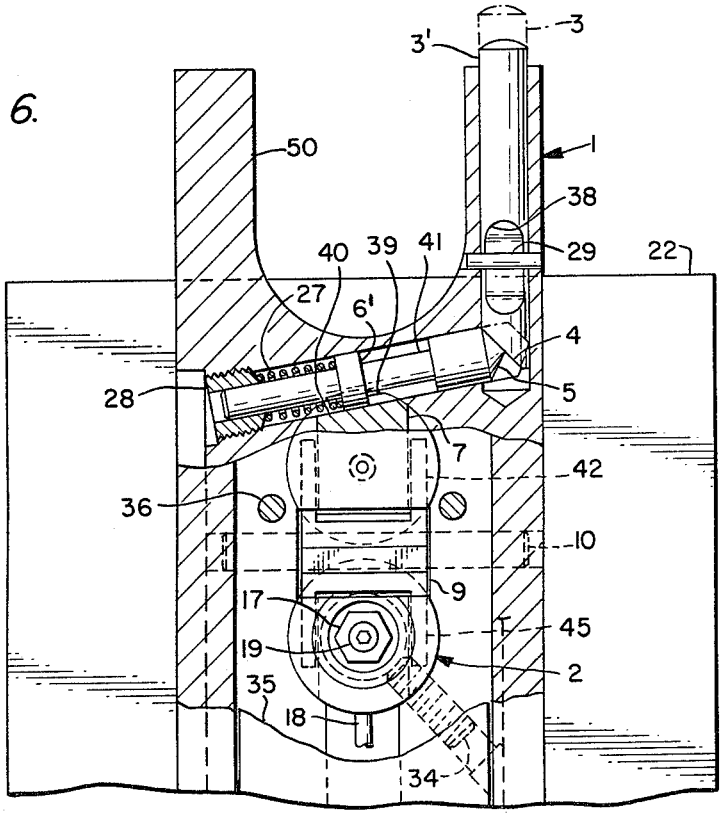
FIG. 6 is a fragmentary sectional view in rear elevation, taken along line 6—6 in FIG. 5, looking in the direction of the arrows.

A plunger latch 6 is movable in a mating blind bore extending transversely across the breechblock and opening into the bore 26, and is biased to the right, as viewed in FIGS. 2 and 6, by a spring 27 retained by a threaded plug 28. The weight 7 has a milled flat 40 extending chordwise across its upper surface, but a forward portion of this flat is interrupted by a projection 39. This projection is normally engaged rearwardly by the plunger latch 6 to hold the weight 7 in its forward position, and the firing pin in its retracted position, as shown in FIGS. 1–3.

A latch release plunger or button 3 is slidably received in a mating blind bore intersecting the end of the bore of the plunger latch 6, and is vertically movable within limits set by a retaining pin 29 received across a flat 38 milled in the button. The distal end of the button 3 has an angled cam surface 4, which bears against a conical tip 5 of the latch 6, so that the spring 27 normally acts through the latch to bias the button to the raised position shown in FIGS. 1 and 2.

Figure 5:
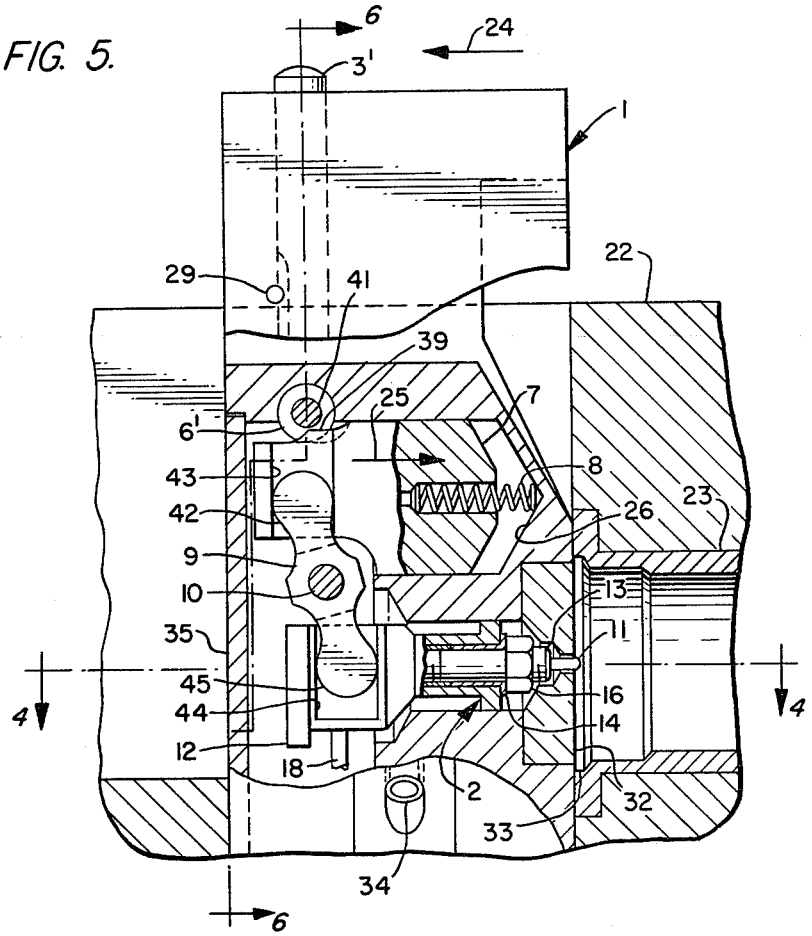
FIG. 5 is a fragmentary sectional view in side elevation, showing the firing pin assembly advanced to firing position.

When the gun loader has opened the breechblock, loaded a shell in the chamber 33, reclosed the breechblock, and ascertained that the gun may safely be fired, he depresses the button 3 to a position 3′ shown in FIGS. 5 and 6. This cams the plunger latch 6 to the left, to a released position 6′. A reduced portion 41 of the latch is then aligned with the projection 39, permitting the spring 8 to move the weight 7 to the rear, and the firing pin assembly forward to its firing position. After the gun loader releases the button 3, the latch 6 is retained in the released position 6′ by the rearwardly-displaced projection 39. The gun is thus placed in condition to be fired by energizing the lead 18.

The inertia weight is designed to have a substantially greater mass than the firing pin assembly. Therefore, when the gun is fired, the ensuing rearward recoil of the gun, in the direction of the arrow 24 in FIG. 5, causes the inertia weight 7 to move forward in the opposite direction, as shown by the arrow 25. The weight bottoms in its bore 26, compressing the spring 8, and retracts the firing pin assembly to the position shown in FIGS. 1–3. The weight is then latched in its forward position by a spring-biased movement of the latch 6 to its normal latching position behind the forwardly-displaced projection 39. This movement also raises the release button 3 to its original position. It will be apparent that the gun cannot be fired again until the button 3 is once again depressed.

Figure 4:
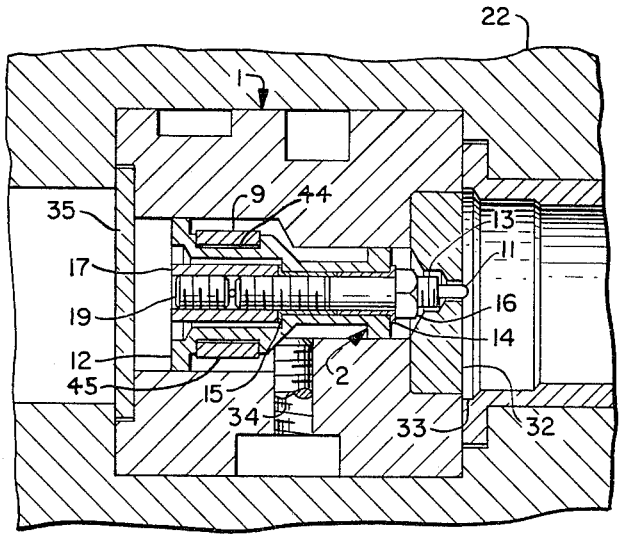
FIG. 4 is a fragmentary sectional plan view taken along line 4—4 in FIG. 5, looking in the direction of the arrows, and showing the firing pin assembly advanced to firing position.

The maximum distance that the firing pin tip 11 may protrude from the front face of the breechblock 1 is adjustably limited by a set screw 34 threaded into a side wall of the breechblock, as best shown in FIGS. 3 and 4. The tip of this screw is engageable by the housing 12 to define the limiting forward displacement of the firing pin assembly 2 in its firing position.

In the event of a misfire, it is necessary to open the breechblock with the firing pin tip biased by the spring 8 into its forward firing position, which will rub the tip over the base of the shell and strike it against the edge of the chamber 33. This will also happen in the event it is decided not to fire a shell after the button 3 has been depressed, of if the button is accidentally depressed when the gun is unloaded. To minimize the possibility of damage to the firing pin tip when these events occur, it is desirable to adjust the screw 34 so that the tip protrudes the minimum distance required to insure good electrical contact with the shell primers. The tip is provided with a substantially conical point to produce a rearward camming action when it engages the edge of the chamber 33, which also reduces the risk of damaging it.

It would be feasible to provide an opening with a removable plug in the cover plate 35 behind the weight 7, so that when any of the foregoing misadventures occurred, a tool could be inserted to push the weight forward, and thus latch the firing pin assembly in its retracted position. However, the frequency of these occurrences and the concomitant risk of damaging the tip 11 are not considered great enough to justify the delay in firing that this manipulation would require.

I claim:

1. A recoil-operated firing pin retractor for use in an electrically-fired gun which includes a barrel having a rear breech opening; a yoke secured to said barrel and formed with a passage extending transversely to the length of said barrel and intersecting said breech opening; a breechblock received in said passage and having a front surface slidably engageable with said breech opening of said barrel; means for reciprocating said breechblock in said passage between positions in which said front surface thereof opens and closes said breech opening; and electrical firing pin means reciprocable in said breechblock between a firing position protruding from said front surface for extension into said breech opening into electrical firing contact with a shell received in said barrel, and a position retracted behind said front surface; said improved firing pin retractor comprising, in combination:

an inertia weight reciprocably received in said breechblock for movement between forward and rearward positions; means biasing said weight toward said rearward position; linkage means drivingly inter-connecting said weight with said firing pin means and constructed and arranged to displace said firing pin means to said retracted and firing positions thereof in response, respectively, to movement of said weight to said forward and rearward positions thereof; and releasable latching means constructed and arranged for latching said weight in place in response to movement of said weight to said forward position thereof; recoil movement of said gun responsive to firing a shell being operative to produce inertial movement of said weight into said forward position and into latched engagement with said latching means, thereby positioning and releasably retaining said firing pin means in said retracted position.

2. A firing pin retractor as recited in claim 1, said linkage means comprising a rocker arm having opposite ends drivingly connected with said weight and said firing pin means, and supported for pivotal movement about an axis positioned between said weight and said firing pin means, whereby said firing pin means is displaced, in response to movements of said weight, in an opposite direction thereto.

3. A firing pin retractor as recited in claim 1, said weight having a substantially greater mass than said firing pin means, effective to overcome said biasing means and to displace said firing pin means to said retracted position in response to inertial movement of said weight to said forward position.

4. A firing pin retractor as recited in claim 1, together with manually-operable means for releasing said weight from latched engagement with said latching means for movement of said weight to said rearward position thereof by said biasing means.

5. A firing pin retractor as recited in claim 1, said latching means comprising a plunger received in said breechblock for movement transverse to the path of movement of said weight between said forward and rearward positions thereof, and further biasing means urging said plunger into non-latching engagement with said weight in said rearward position thereof; said further biasing means being operative to move said plunger into said path behind said weight as said weight moves into said forward position, whereby said plunger latches said weight against a return movement to said rearward position.

6. A firing pin retractor as recited in claim 5, together with manually-operable latch release means constructed and arranged for withdrawing said plunger from said path of movement of said weight against the urging of said further biasing means, and thereby releasing said weight from latched engagement with said plunger.

7. A firing pin retractor as recited in claim 6, said latch release means and said plunger each being formed with cam surfaces cooperable in response to manual operation of said latch release means to withdraw said plunger from said path of movement of said weight.

8. A firing pin retractor as recited in claim 1, said weight being formed with a projection extending transversely to the path of movement thereof between said forward and rearward positions; said latching means comprising a plunger reciprocably received in said breechblock for movement between a position interfering with movement of said projection along said path and a withdrawn position, and means biasing said plunger toward said interfering position; said projection restraining said plunger in said withdrawn position while said weight occupies said rearward position, and said biasing means being operative to displace said plunger into said interfering position upon movement of said weight to said forward position.

9. An electrically-operated firing mechanism for use in a gun which includes a barrel having a rear breech opening; a yoke secured to said barrel and formed with a passage extending transversely to the length of said barrel and intersecting said breech opening; a breechblock received in said passage and having a front surface slidably engageable with said breech opening of said barrel; and means for reciprocating said breechblock in said passage between positions in which said front surface thereof opens and closes said breech opening; said firing mechanism comprising, in combination:

electrical firing pin means; an inertia weight; said breechblock being formed with a first bore transverse to said front surface and opening onto said front surface, said first bore receiving said firing pin means for reciprocation therein between a firing position protruding from said front surface for extension into said breech opening into electrical firing contact with a shell received in said barrel, and a position retracted behind said front surface; said breechblock being formed with a second bore spaced from said first bore and extending in a direction having a component longitudinal to said barrel, said second bore receiving said inertia weight for reciprocation therein between forward and rearward positions; first biasing means urging said weight toward said rearward position; rocker arm means pivotally mounted in said breechblock for oscillation about an axis transverse to the length of said barrel and located between said first and second bores, said rocker arm means drivingly interconnecting said weight with said firing pin means to displace said firing pin means to said retracted and firing positions thereof in response, respectively, to movement of said weight to said forward and rearward positions thereof; latching means movably mounted in said breechblock for releasably latching said weight against rearward movement; second biasing means operative to move said latching means to latch said weight in place upon movement of said weight to said forward position thereof; recoil movement of said gun responsive to firing a shell being operative to produce inertial movement of said weight into said forward position and into latched engagement with said latching means, thereby positioning and latching said firing pin means in said retracted position; and manually-operable means for moving said latching means out of latched engagement with said weight for return of said weight by said first biasing means to said rearward position.

10. A firing mechanism as recited in claim 9, said inertia weight having a substantially greater mass than said firing pin means, effective to overcome said first biasing means and to displace said firing pin means to said retracted position in response to recoil movement of said gun upon firing a shell.

* * * * *